US005511254A

United States Patent [19]

O'Brien

[11] Patent Number: 5,511,254

[45] Date of Patent: Apr. 30, 1996

[54] PORTABLE STEAM SAUNA

[75] Inventor: Michael P. O'Brien, Cape Coral, Fla.

[73] Assignee: Evergreen Soft Spa, Inc., Berkley, Mich.

[21] Appl. No.: 275,518

[22] Filed: Jul. 15, 1994

[51] Int. Cl.[6] ..... A61H 33/06

[52] U.S. Cl. ..... 4/532; 4/526; 135/157

[58] Field of Search ..... 4/524, 526, 527, 4/528, 529, 530, 531, 532, 599, 585, 598; 135/92, 121, 128, 137, 157, 158, 901

[56] References Cited

U.S. PATENT DOCUMENTS

| | | | |
|---|---|---|---|
| 1,386,176 | 8/1921 | Holmes | 4/598 |
| 1,404,485 | 1/1922 | Shellady | 135/157 X |
| 1,932,122 | 10/1933 | Schulte | 4/527 |
| 2,243,550 | 5/1941 | Carl | 4/532 |
| 2,267,658 | 12/1941 | Larsen | 4/599 X |
| 2,539,710 | 1/1951 | Sziklay | 4/527 |
| 2,873,453 | 2/1959 | Kirschner | 4/527 |
| 3,027,189 | 3/1962 | Scott | 135/901 X |
| 3,034,523 | 5/1962 | De Shano | 135/128 X |
| 3,351,957 | 11/1967 | Ikeda | 4/526 |
| 3,606,618 | 9/1971 | Veech | 4/603 |
| 3,945,058 | 3/1976 | Gardner | 4/530 X |
| 4,031,573 | 6/1977 | Romanoff | 4/532 |
| 4,446,356 | 5/1984 | Rimmi | 4/524 X |
| 4,675,923 | 6/1987 | Ashley | 4/599 |
| 4,773,105 | 9/1988 | Toyoshima | 4/526 |
| 4,844,333 | 7/1989 | Davis et al. | 4/524 X |
| 4,928,581 | 5/1990 | Jacobson | 98/1.5 |
| 4,975,992 | 12/1990 | Patterson et al. | 4/599 |
| 5,133,378 | 7/1992 | Tanasychuk | 135/901 X |

FOREIGN PATENT DOCUMENTS

| | | | |
|---|---|---|---|
| 0395123 | 2/1909 | France | 4/527 |
| 0102138 | 11/1923 | Switzerland | 4/524 |
| 0023658 | of 1899 | United Kingdom | 4/526 |
| 2241165 | 8/1991 | United Kingdom | 4/531 |

*Primary Examiner*—Robert M. Fetsuga
*Attorney, Agent, or Firm*—Young & Basile

[57] ABSTRACT

A portable steam sauna that provides a framing structure having a plurality of detachable framing members and coupling members wherein each coupling member releasably engages at least two framing members for manually assembling and disassembling the framing structure while utilizing a flexible, light-weight, soft, steamproof enclosure material for forming a steamproof enclosure. The framing structure utilizes light-weight, non-metallic, rigid framing members and coupling members having hollow cylindrical structures. The framing members and coupling members are preferably fabricated from a conventional polyvinyl chloride which will remain comfortable to a user's touch even in elevated temperatures. The releasable engagement between the coupling members and the framing members is a frictional fit to assure the framing structure remains assembled when said steam sauna is in use while also allowing for the manual disassembly and reassembly of the framing structure when the portable steam sauna is not in use. The framing structure may be completely assembled and reassembled without the use of conventional fasteners. The enclosure material utilizes a light-weight, flexible, soft, vinyl for enclosing the framing structure and providing a comfortable feel to the user's touch. The framing structure extends upward from a base which contains a steam producing device for providing steam within the enclosure. A control device for controlling the steam producing device is provided for both inside and outside the enclosure.

16 Claims, 2 Drawing Sheets

PORTABLE STEAM SAUNA

FIELD OF THE INVENTION

The present invention relates, in general, to portable steam saunas, and in particular, a light-weight, inexpensive portable steam sauna that provides a plurality of detachable framing members and coupling members for manually assembling and disassembling the frame of the portable steam sauna as well as providing a soft vinyl enclosure material for enclosing the frame and forming a steamproof enclosure.

BACKGROUND OF THE INVENTION

Portable and collapsible steam saunas are well known in the art. These steam saunas have many advantages over stationary and permanent steam saunas such as portability and ease of use in remote locations, quick and convenient set up and use, readably foldable into convenient packages for ease of carrying, etc.

Unfortunately, many portable steam saunas utilize structures which are not practical and reliable for use in the environments in which they are utilized, i.e. excessive heat and moisture. For example, such structures utilize metal framing structures which typically rust and corrode in environments containing excessive moisture. Typically, most metallic frame members are good heat conductors and may become dangerously hot, especially when a user comes in contact with the metallic frame members. Also, such metallic frame members may be unnecessarily heavy thus adding weight to the steam sauna and decreasing the convenience of the portability feature of the steam sauna.

Other portable steam sauna structures utilize hinges, brackets, linkages, telescopic cylinders, struts, and other conventional fasteners to collapse, fold, and portablize their steam sauna structures. Such fasteners, especially fasteners fabricated from metallic materials or fasteners that require lubrication to function properly, are not reliable when utilized in environments containing excessive heat and moisture. Such fasteners may corrode and loose their lubrication such that their performance degrades or fails completely. Also, the continuous functioning of these fasteners may lead to the loosening and constant readjustment of such fasteners in order that such fasteners perform properly. Again, metallic components typically add weight to the structure thus reducing the convenience of the portability feature of the steam sauna while also conducting heat thus becoming uncomfortably hot when contacted by a user.

To enclose such framing structures, many of the prior known portable steam saunas utilize wood, plastics, leathers and acrylics. Such materials are often used for their support and/or portability in order to form and establish a small convenient package. Unfortunately, many of these materials have hard surface characteristics as well as having heat bearing characteristics, and thus, these materials may be uncomfortable when contacted by a user.

SUMMARY OF THE INVENTION

The present invention solves the above short comings by providing a portable steam sauna that provides a framing means having a plurality of detachable framing members and coupling members wherein each coupling member releasably engages at least two framing members for manually assembling and disassembling the framing means while utilizing a flexible, light-weight and soft means for enclosing said framing means and forming a steamproof enclosure. The framing means is connected to and extends upward from a base wherein a means for producing steam is self-contained within the base.

The framing and coupling members of the framing means are fabricated from a light-weight, non-metallic, rigid material, preferably a polyvinyl chloride, having a hollow, cylindrical structure. The framing members are elongated and have a longitudinal axis wherein the framing means is assembled by moving the framing members along their longitudinal axes toward a coupling member. The coupling member receives the framing member and establishes a frictional pipe fit so that the framing means remains assembled when the steam sauna is in use while also allowing for the manual disassembly and reassembly of the framing means when the steam sauna is not in use. The non-metallic material of the framing means insures that the framing means will not be hot to the touch of a user, and the cylindrical structure of the framing means provide a smooth surface should a user come in contact with the framing means. The framing means does not require the use of conventional fasteners, and thus, the user need not be concerned with the degradation of the performance of such conventional fasteners due to corrosion or lack of lubricants nor does the user have to be concerned with contacting metallic fasteners and having the fasteners be hot to the user's touch.

The enclosing means utilizes a soft, lightweight, flexible, steamproof vinyl that encloses the framing means and forms an enclosure to withhold heat and steam. The vinyl is soft to a user's touch and will not conduct heat like other enclosure materials. The vinyl may be substantially transparent, opaque, tinted and mirrored or any combination thereof. A slit is provided in the front of the vinyl enclosure to allow a user to enter and exit the enclosure, and a plastic zipper is utilized to open and close the slit from both the inside and the outside of the enclosure.

The base is fabricated from a molded plastic, and a steam producing means is connected to and self-contained within the base. A drain is molded into the base for collecting excess water from the steam sauna. A control means is also provided in the base for starting and stopping the steam producing means.

To this end, the objects of the present invention are to provide a new and improved portable steam sauna having a light-weight, non-metallic, inexpensive, rigid framing means that may be manually assembled and disassembled while still being comfortable to a user's touch; and to provide a new and improved portable steam sauna having a flexible, light-weight and soft enclosing means for enclosing the framing means and forming a steamproof enclosure that is comfortable to a user's touch.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
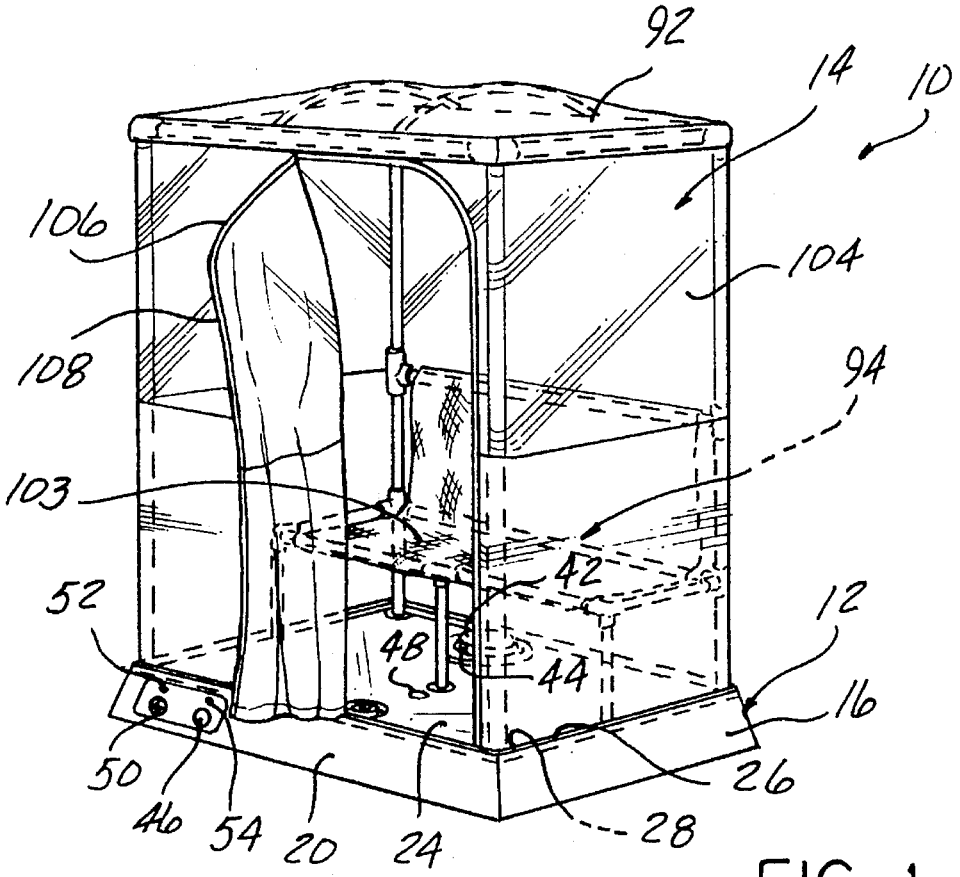
FIG. 1 is a perspective view of the portable steam sauna made according to the present invention.

FIG. 1 is a perspective view of a portable steam sauna 10 according to the present invention. The portable steam sauna 10 provides a framing means that is connected to and extends upward from a base 12. An enclosure means encloses the periphery of the framing means to form a steamproof enclosure 14. A steam producing means is contained in the base 12 and provides steam within the enclosure 14 of the portable steam sauna 10.

Figure 3:
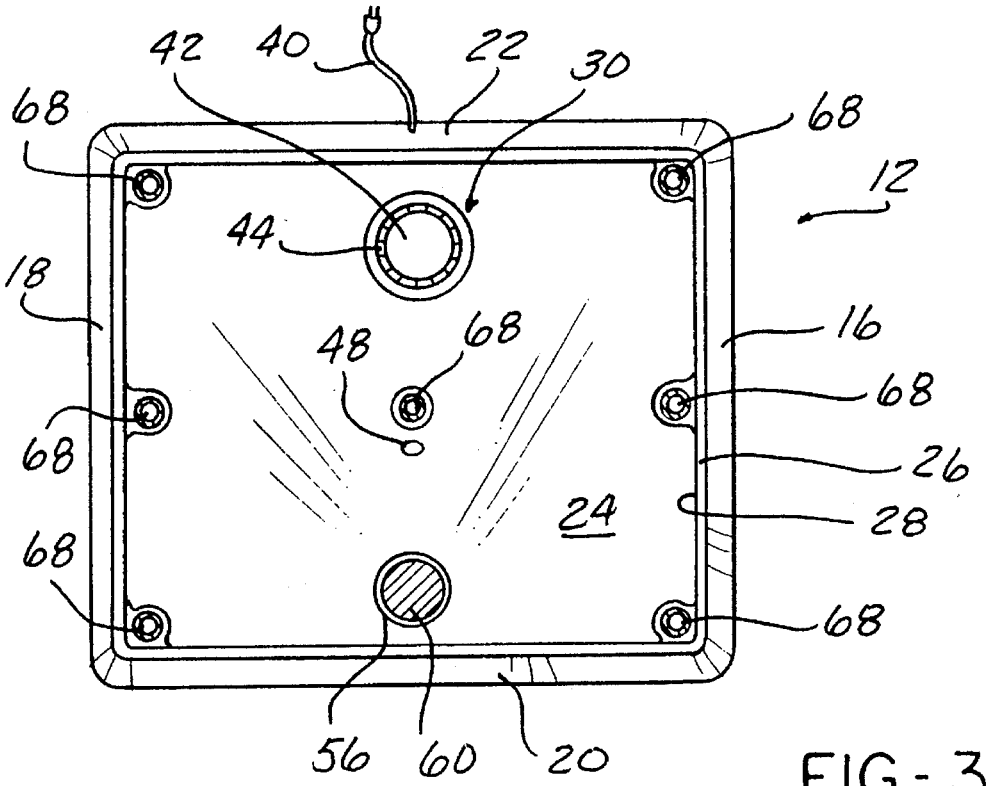
FIG. 3 is a top plane view of the base of the portable steam sauna.
Figure 2:
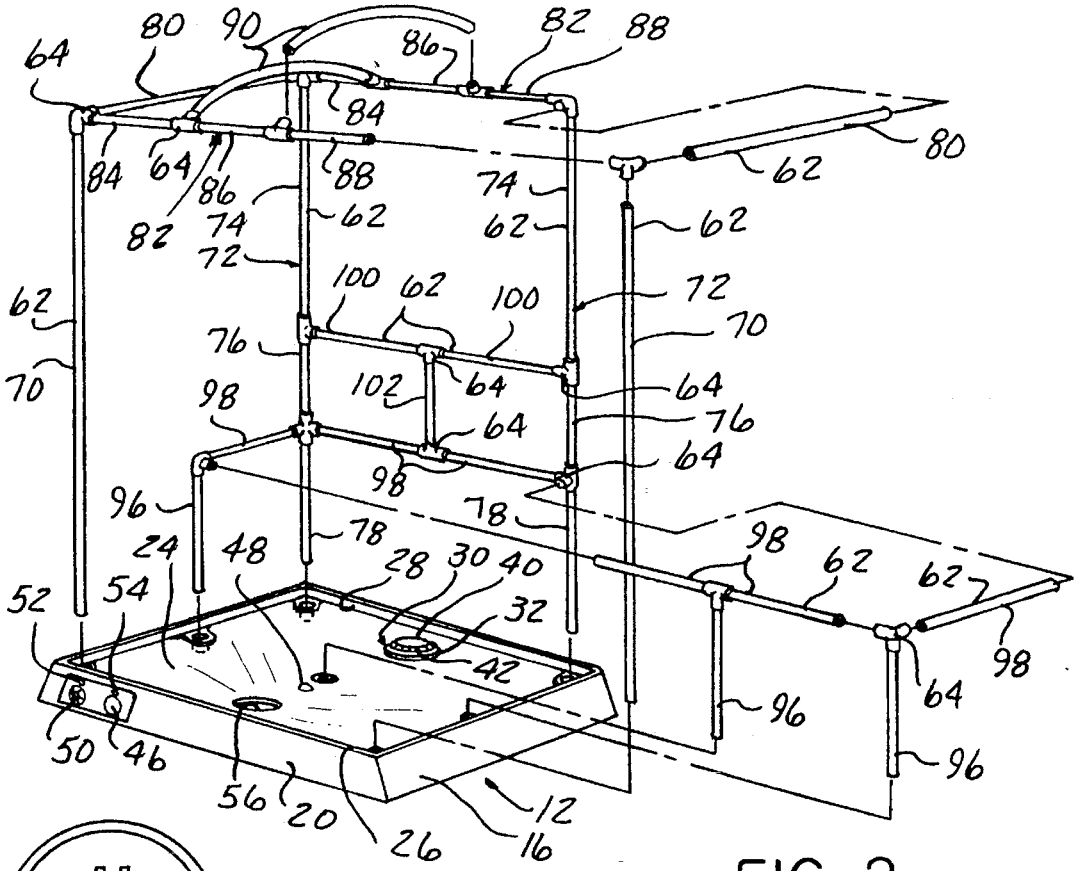
FIG. 2 is an exploded view showing the framing means and the base of the portable steam sauna.

To support the portable steam sauna 10, the base 12 of the portable steam sauna 10 is fabricated from a conventional molded plastic wherein the base 12 has a pair of substantially parallel sides 16, 18, a front side 20, a rear side 22 and a top surface 24, as seen in FIGS. 1–3, which acts as the floor of the portable steam sauna 10. The four sides 16, 18, 20, 22 of the base 12 form a rectangular structure wherein the four sides 16, 18, 20, 22 of the base 12 are angled inward toward one another in order to provide stability to the portable steam sauna 10. The top surface 24 of the base 10 or floor 24 of the portable steam sauna 10 is slightly lower than the top 26 of the four sides 16, 18, 20, 24 of the base 12 such that a raised edge or lip 28 is formed. The lip or raised edge 28 overlaps a bottom edge (not shown) of the enclosing means to withhold the steam and heat within the enclosure 14. The lip or raised edge 28 may also act as a retainer for retaining any excess water (not shown) which may accumulate upon the floor 24 of the portable steam sauna 10.

In order to have the steam producing means self contained within the base 12 of the portable steam sauna 10, an aperture (not shown) is provided in the floor 24 of the portable steam sauna 10. A fluid container or steam pot 30 extends through the aperture, and a lip or flange 32 on the steam pot 30 has a diameter larger than the aperture in the floor 24 of the portable steam sauna 10 so that the lip or flange 32 abuts against the floor 24 of the portable steam sauna 10 and supports the weight of the steam pot 30, as seen in FIGS. 2–3 and 5–6. The steam pot 30 is then fixedly mounted to the floor 24 of the portable steam sauna 10 through the use of conventional fasteners or adhesives (not shown).

Figure 4:
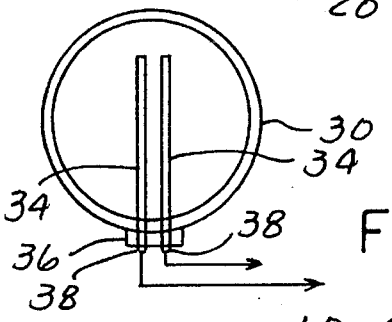
FIG. 4 is a schematic drawing showing the monolithic graphite rods in the steam pot of the portable steam sauna.

To heat the fluid (not shown) within the steam pot 30 and produce steam (not shown), a pair of monolithic graphite rods 34 extend into the steam pot 30 and are submersed within the fluid contained in the steam pot 30, as seen in FIG. 4. The monolithic graphite rods 34 extend through an aperture (not shown) provided in the side of the steam pot 30 below the floor 24 of the portable steam sauna 10. A coupling 36 secures the monolithic graphite rods 34 so that a portion 38 of the rods 34 extend outside the steam pot 30. The coupling 36 also seals the aperture from the fluid contained in the steam pot 30. Electric current is supplied to one of the monolithic graphite rods 34 and the other rod remains neutral so that the fluid contained within the steam pot 30 acts as an electrical resistor between the monolithic graphite rods 34. The electrical resistance heats the fluid to a level in which the fluid begins to evaporate and thus produce steam. As seen in FIG. 3, an electrical cord 40 supplies the electric current to the monolithic graphite rod 34, and the cord 40 extends underneath the floor 24 of the portable steam sauna 10 and through the back side 22 of the base 12 such that the electrical cord 40 is not exposed within the enclosure 14 of the portable steam sauna 10. As seen in FIGS. 1–3, a grate 42 is fastened by conventional fasteners (not shown) to the top of the steam pot 30 above the floor 24 of the portable steam sauna 10 such that steam is allowed to escape through openings 44 in the grate 42 while preventing a user (not shown) from exposing himself to the hot fluid within the steam pot 30.

To control the production of steam, a controlling means is provided from both inside and outside the enclosure 14. A central pneumatic air means having a first and second pneumatic air switch 46, 48 is provided for controlling the power to the monolithic graphite rods 34. As seen in FIGS. 1–3 and 5, the first pneumatic switch 46 is provided on the front side 20 of the base 12 so that power can be switched off and on to the monolithic graphite rods 34 from the outside of the enclosure 14. The second pneumatic switch 48 is provided on the floor 24 of the portable steam sauna 10 so that the user can switch the power on and off to the monolithic graphite rods 34 from within the enclosure 14. The pneumatic switches 46, 48 are utilized to enhance the safety of the user in light of the excessive moisture within the enclosure 14. A timer 50 is also provided on the front side 20 of the base 12 so that the power to the monolithic graphite rods 34 will automatically shut off after a predetermined amount of time. A pair of indicator lights 52, 54 are also provided on the front side 20 of the base 12. One of the lights 52 indicates that the power is accessible due to the timer 50 being actuated. The timer 50 must be actuated before the power can be manipulated by the pneumatic switches 46,48. The second light 54 indicates that power is being supplied to the monolithic graphite rods 34 by actuation of one of the pneumatic switches 46, 48, and therefore, the light 54 indicates steam is being produced.

Figure 5:
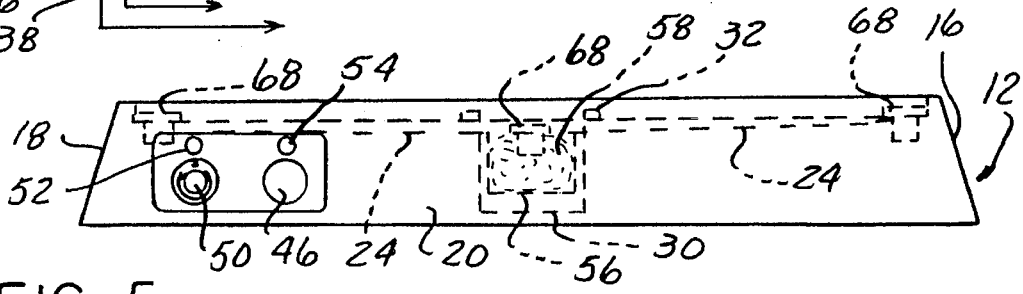
FIG. 5 is a front view of the base of the portable steam sauna showing the floor inclined for directing excess water to the drain.
Figure 6:
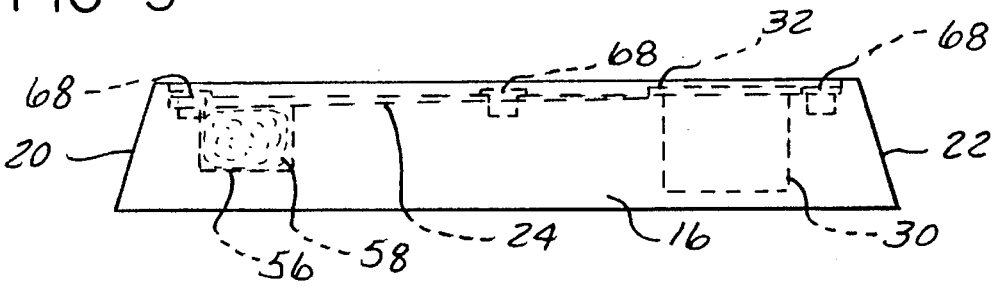
FIG. 6 is a side view of the base of the portable steam sauna showing the floor angled for draining excess water to the drain.

As seen in FIGS. 2–3 and 5–6, drainage of excess water within the enclosure 14 of the portable steam sauna 10 occurs by sloping the floor 24 of the portable steam sauna 10 toward a drain 56 which is molded into the base 12. As best seen in FIG. 5, the floor 24 slopes downward from the sides 16, 18 of the base 12 toward the center of the floor 24 where the drain 56 is located, and as best seen in FIG. 6, the floor 24 also slopes from the rear 22 of the base 12 toward the front 20 of the base 12. A sponge 58 is provided within the recess of the drain 56 in order to absorb the water and provide a means in which the user may easily remove the water within the drain 56. A detachable grate 60 may be placed over the drain 56 in order that the user may access the sponge 58 while not stepping into the recess of the drain 56 when not accessing the sponge 58.

To frame the enclosure 14 of the portable steam sauna 10, the framing means provides a plurality of light weight, non-metallic, rigid framing members 62 and coupling members 64 as seen in FIG. 2, preferably fabricated from a conventional polyvinyl chloride, such as a furniture grade, schedule 40 polyvinyl chloride pipe. The framing members 62 have elongated hollow, cylindrical structures, and the coupling members 64 have similar hollow, cylindrical structures, but the coupling members 64 typically have several cylindrical portions at substantially right angles to one another for receiving the framing members 62 and creating corners to a frame 66 of the portable steam sauna 10. The outer diameter of the framing members 62 are slightly smaller than the inner diameter of the coupling members 64 so that the framing members 62 are slidably received within the coupling members 64, and the ends of the framing members 62 abut a radial flange (not shown) extending radially inward within the coupling member 64 once the framing member 62 is fully received. The diameters of the framing members 62 and the coupling members 64 are similar in size such that a frictional fit is maintained between the two members 62, 64. The frictional fit is tight enough such that the assembly of the frame 66 is maintained during the use of the portable steam sauna 10, while also being able to disassemble and reassemble the frame 66 when the portable steam sauna 10 is not in use.

In order to connect the frame 66 to the base 42, the floor 24 of the portable steam sauna 10 has seven apertures or recesses 68 for receiving the ends of the framing members 62, as best seen in FIG. 3. These apertures or recesses 68 provide similar engagements with the framing members 62 as noted above with the coupling members 64. As seen in FIG. 2, the frame 66 has four main framing members 70, 72 extending upward from the four corners of the base 12. The two rear main framing members 72 are formed by three shorter framing members 74, 76, 78 coaxially aligned along their common longitudinal axis. Four framing members 80, 82 connect the four main framing members 70, 72 at the top of the frame 66. The front and rear top framing members 82 are formed by three shorter framing members 84, 86, 88 coaxially aligned along their common longitudinal axis. At the top of the frame 66, a pair of arcuate framing members 90 extend from the front to the rear of the frame 66 in order to support a roof or canopy 92, as seen in FIG. 1, of the enclosing means, which will be described in detail later. It should be noted that apertures may be provided in the framing members instead of the coupling members.

A bench seat 94 is framed within the enclosure 14 by having three framing members 96 extend upward from the floor 24 of the portable steam sauna 10 to support framing members 98 that frame the horizontal portion of the bench seat 94. A horizontal framing member 100 extends across the back of the enclosure 14 and a vertical framing member 102 supports the horizontal framing member 100 in order to frame the back rest or vertical portion of the bench seat 94. A porous cloth material 103, such as a broadly weaved vinyl material, extends across the horizontal and vertical portions of the bench seat 94 by being sewn around framing members 100 and 98. The porous cloth material 103 supports the weight of the user while also allowing for steam to access the user's legs.

It should be noted that the present invention is not limited to this particular structure for framing the enclosure 14, but rather, the framing members 62 may be utilized in any manner in which the enclosure 14 is properly supported for the use of the portable steam sauna 10.

To enclose the frame 66, the enclosing means utilizes a flexible, light-weight, soft, steamproof vinyl 104 for forming the enclosure 14. The vinyl enclosure 104 is one piece with a slit 106 extending down the front side of the vinyl enclosure 104. A plastic zipper 108 is connected to the edges of the slit 106 so that the user may open and close the vinyl enclosure 104 from both the outside and the inside of the enclosure 14. Conventional cloth fasteners (not shown) having two opposing strips of material wherein one strip has a multiplicity of anchor-type hooks fixedly attached on one side for positively engaging a second strip having felt-like fibers which are commonly manufactured under the trade name "VELCRO". "VELCRO" may be placed on the bottom corners of the vinyl enclosure 104 and the frame 66 in order to help maintain the position of the vinyl enclosure 104. The vinyl enclosure 104 may be substantially transparent, opaque, tinted, mirrored or any combination thereof, depending on the desire of the user. Preferably, the bottom half of the vinyl enclosure 104 is opaque and the top half is tinted and mirrored.

To assemble the portable steam sauna 10, the bottom framing members 70, 78, 96 of the frame 66 are manually inserted into the recesses 68 of the base 12 by moving the framing members 70, 78, 96 along their longitudinal axis toward the recesses 68 in the base 12. The remainder of the framing members 62 are manually assembled to the coupling members 64 by similarly moving the framing members 62 along their longitudinal axis toward the coupling members 64 wherein the coupling members 64 slidably receive the ends of the framing members 62. The framing members 62 are continually inserted into the coupling members 64 until the end of the framing member 62 abuts the radial flange within the coupling member 64. This assembly process is repeated until the frame 66 of the portable steam sauna 10 is completed.

The vinyl enclosure 104 is fitted onto the frame 66 by pulling the vinyl enclosure 104 down from the top to the bottom of the frame 66 while having the zipper 108 of the vinyl enclosure 104 open in order to provide a proper amount of slack when fitting the vinyl enclosure 104 on the frame 66. Once the vinyl enclosure 104 is properly orientated on the frame 66, the cloth fasteners on the bottom corners of the vinyl enclosure 104 and frame 66 are fastened in order to help maintain the position of the vinyl enclosure 104 relative to the frame 66. Water, along with any other desirable mineral oils, scented oils or medicated fluids (not shown), are then added to the steam pot 30. The timer 50 is set, and power is accessible as indicated by the power indicating light 52. One of the pneumatic air switches 46, 48 is actuated, and power is then supplied to the monolithic graphite rods 34 as indicated by the steam indicating light 54. The monolithic graphite rods 34 heat the fluid within the steam pot 30 thus producing steam. The temperature within the enclosure 14 will reach a range of 95°–125° F. at 100% relative humidity. The user may adjust the temperature and steam within the enclosure 14 by turning on and off the power to the monolithic graphite rods 34 through the use of either of the pneumatic air switches 46, 48.

It should be noted that while the present invention does not provide for conventional fasteners in assembling the frame 66, it may be necessary, although not anticipated, to use a conventional fastener should the framing members 62 and coupling members 64 unexpectedly wear so that a proper amount of friction is not provided to maintain the assembly of said frame 66 when the steam sauna 10 is in use.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A portable steam sauna comprising:

a base having a top surface for defining a floor of said steam sauna, and said base having a plurality of integrally formed closed-end receptacles;

a frame received by said receptacles of said base and having a plurality of detachable elongated framing members and coupling members wherein each of said coupling members releasably engages the ends of said elongated framing members for manually assembling and disasembling said frame so that said frame remains assembled when said steam sauna is in use while also allowing for the manual disassembly and reassembly of said framing members when said steam sauna is not in use, and said elongated framing members each having a longitudinal axis wherein said frame is manually assembled and disassembled by moving said framing members along said longitudinal axis toward and away from said coupling members wherein said coupling members releasably engage said framing members;

said frame forming four vertically extending side walls wherein three of said four side walls have seat framing members connected to said frame and extending across at least a portion of said three side walls;

a seat connected to and extending between said seat framing members;

a flexible and light weight enclosure material extending about the periphery of said frame for enclosing said frame and forming a single compartment, fully enclosed enclosure; and means for producing steam within said enclosure, said steam producing means including a fluid container connected to said base, and means for heating a fluid in said fluid container for producing steam in said enclosure.

2. The portable steam sauna as stated in claim 1, wherein said framing members and said coupling members are fabricated from a light-weight, non-metallic, rigid material.

3. The portable steam sauna stated in claim 2 wherein said framing members and said coupling members further comprise hollow, cylindrical members fabricated from polyvinyl chloride.

4. The portable steam sauna stated in claim 1, wherein said enclosure material comprises a soft, steamproof vinyl material.

5. The portable steam sauna stated in claim 1 wherein said releasable engagement of said coupling members to said framing members further comprises a frictional fit.

6. A portable steam sauna comprising:

a base having a top surface for defining a floor of said steam sauna, and said base having a plurality of integrally formed closed-end receptacles;

a substantially rectangular frame received by and extending vertically upward from said receptacles of said base, and said frame having a plurality of detachable elongated framing members and coupling members wherein each of said coupling members releasably engages the ends of said elongated framing members for manually assembling and disassembling said frame so that said frame remains assembled when said steam sauna is in use while also allowing for the manual disassembly and reassembly of said frame when said steam sauna is not in use, said elongated framing members each having a longitudinal axis wherein said frame is manually assembled and disassembled by moving said framing members along said longitudinal axis toward and away from said coupling members wherein said coupling members releasably engage said framing members;

said frame forming four vertically extending side walls wherein three of said four side walls have seat framing members connected to said frame and extending across at least a portion of said three side walls;

a flexible, light-weight soft substantially steam proof vinyl extending about the periphery of said frame for enclosing said frame and forming a single compartment, fully enclosed enclosure for holding steam; and means for producing steam within said enclosure, said steam producing means including a fluid container connected to said base, and means for heating a fluid in said fluid container for producing steam in said enclosure.

7. The portable steam sauna stated in claim 6 wherein said framing members and said coupling members are fabricated from a light-weight, non-metallic, rigid material.

8. The portable steam sauna stated in claim 7, wherein said framing members and said coupling members further comprise hollow, cylindrical members fabricated from polyvinyl chloride.

9. The portable steam sauna stated in claim 6, further comprising:

a slit formed in said vinyl for allowing passage of a user into and out of said enclosure; and means for releasably fastening said slit to open and close said slit from both the inside and outside of said enclosure.

10. The portable steam sauna stated in claim 9, wherein said releasable fastening means comprises a non-metallic sliding fastener.

11. The portable steam sauna stated in claim 6, wherein said means for heating a fluid comprises:

a pair of spaced monolithic graphite rods disposed in said fluid container and submersed in said fluid wherein an electric current is applied to one of said rods such that electrical resistance of said fluid between said rods heats said fluid.

12. The portable steam sauna stated in claim 6, including:

means for framing a seat within said enclosure; and a porous material overlapping and extending between said seat framing means for supporting a user when seated thereon while allowing steam to pass through said porous material.

13. The portable steam sauna stated in claim 6, including means for controlling said steam producing means.

14. The portable steam sauna stated in claim 6 wherein said releasable engagement of said coupling members to said framing members further comprises a frictional fit.

15. A portable steam sauna comprising:

a base having a top surface for defining a floor of said steam sauna, and said base having a plurality of integrally formed closed-end receptacles;

a substantially rectangular frame received by and extending vertically upward from said receptacles of said base, and said frame having a plurality of detachable elongated framing members and coupling members wherein each of said coupling members releasably engages the ends of said elongated framing members for manually assembling and disassembling said frame so that said frame remains assembled when said steam sauna is in use while also allowing for the manual disassembly and reassembly of said frame when said steam sauna is not in use;

said frame forming four vertically extending side walls wherein three of said four side walls have framing members extending across at least a portion of said side walls and forming support for an occupant seat and back rest;

a flexible, light-weight, soft substantially steam proof vinyl extending about the periphery of said frame for enclosing said frame and forming a single compartment, fully enclosed enclosure for holding steam;

a fluid container connected to said base;

means for heating the fluid in said fluid container for producing steam in said enclosure;

a first pneumatic air switch inside said enclosure for starting and stopping said steam producing means; and a second pneumatic air switch outside said enclosure for starting and stopping said steam producing means.

16. A portable steam sauna comprising:

a base having a top surface for defining a floor of said steam sauna, and said base having a plurality of integrally formed closed-end receptacles;

a frame received by and extending vertically upward from said receptacles of said base, and said frame having a plurality of detachable elongated framing members and coupling members wherein each of said coupling members releasably engages the ends of said elongated framing members for manually assembling and disassembling said frame, and said elongated framing members each having a longitudinal axis wherein said frame is manually assembled and disassembled by moving said framing members along said longitudinal axis toward and away from said coupling members wherein said coupling members releasably engage said framing members;

a flexible, light-weight soft-substantially steam proof vinyl extending about the periphery of said frame for enclosing said frame and forming a single compartment, fully enclosed enclosure;

means for producing steam within said enclosure, said steam producing means including a fluid container recessed in said top surface of said base, and means for heating the fluid in said steam container for producing steam in said enclosure; and at least one pneumatic air switch mounted to said base for starting and stopping said steam producing means.

* * * * *